US005616895A

United States Patent [19]

Spiess

[11] Patent Number: 5,616,895

[45] Date of Patent: Apr. 1, 1997

[54] DOOR SAFETY CIRCUIT FOR MONITORING OF STORY DOORS IN LIFT INSTALLATIONS

[75] Inventor: Peter Spiess, Meggen, Switzerland

[73] Assignee: Inventio AG, Hergiswil, Switzerland

[21] Appl. No.: 318,431

[22] Filed: Oct. 5, 1994

[30] Foreign Application Priority Data

Oct. 6, 1993 [CH] Switzerland ..... 03006/93

[51] Int. Cl.[6] ..... B66B 1/28; B66B 1/34; B66B 3/00

[52] U.S. Cl. ..... 187/280; 187/317; 187/393; 187/391

[58] Field of Search ..... 187/280, 391, 187/393, 317, 331

[56] References Cited

U.S. PATENT DOCUMENTS

| | | | |
|---|---|---|---|
| 4,009,767 | 3/1977 | Stadigh | 187/31 |
| 4,623,869 | 11/1986 | Marubashi | 340/19 |
| 5,107,964 | 4/1992 | Coste et al. | 187/104 |
| 5,509,505 | 4/1996 | Steger et al. | 187/394 |

FOREIGN PATENT DOCUMENTS

| | | | |
|---|---|---|---|
| 0455919 | 11/1991 | European Pat. Off. . | |
| 1432651 | 2/1966 | France . | |
| 2610402 | 8/1988 | France . | |
| 810423 | 8/1951 | Germany . | |
| 876371 | 8/1961 | United Kingdom | 187/280 |

*Primary Examiner*—Robert Nappi
*Attorney, Agent, or Firm*—Greenblum & Bernstein P.L.C.

[57] ABSTRACT

A door safety circuit for monitoring of story doors in lift installations. The door safety circuit includes a transmitter that produces a non-electrical signal which is guided by a series of conductor portions. The non-electrical signal may be transmitted through a first conductor partial portion to a latching device of a first story door, depending upon the latched state of the first story door, the signal may be either transmitted to a second conductor partial portion, which may be included within the latching device, or no longer transmitted. If the signal is similarly transmitted through a plurality of conductor partial portions and serially connected story door latching devices, the circuit may indicate that each story door is properly latched. The circuit may also include a plurality of sensors coupled to a failure recognition circuit for monitoring each conductor partial portion.

29 Claims, 3 Drawing Sheets

DOOR SAFETY CIRCUIT FOR MONITORING OF STORY DOORS IN LIFT INSTALLATIONS

CROSS REFERENCE TO RELATED APPLICATIONS

This application claims the priority of Swiss Application No. 03 006/93-0, filed Oct. 6, 1993, the disclosure of which is incorporated herein by reference in its entirety.

BACKGROUND OF THE INVENTION

1. Field of the Invention

The present invention pertains to a door safety circuit for the monitoring of at least one story door of an elevator or lift installation, which circuit includes a transmitter and a receiver, wherein a non-electrical signal, produced by the transmitter and influenced by a latching device of the story door, is conveyed to the receiver for conversion into an electrical signal.

2. Discussion of the Background of the Invention and Material Information

French Patent Publication FR 1 432 651 discloses a safety circuit in which a door latch, monitored by means of a photo-electric device, is used for lift or elevator installations. A light beam emitted by the light source of a photo-electric device arrives, in case the door latch displays a certain setting, at a photo-sensor, with the electrical signal thereof being passed onto the lift or elevator controller.

A disadvantage of the noted device resides in the fault susceptibilities of the transmitter and the receiver, which are exposed to shocks during each latching movement and are thereby subject to excessive stresses.

SUMMARY OF THE INVENTION

The primary object of the invention is to overcome the disadvantages of the prior art. The invention, in the manner set forth in the appended claims, solves the disadvantages of the known devices by constructing a safety circuit so that the latching devices of several story doors are monitorable through non-electrical signals via a circuit including a transmitter and a receiver.

The advantages achieved by the present invention reside substantially in the fact that the safety circuit of this invention is usable in areas of climatically normal conditions as well as also in wet areas and in areas exposed to the dangers of explosion. This permits a standardization of door safety circuits, which in turn entails substantial cost savings with respect to manufacture, assembly, maintenance and replacement parts. Further advantages reside in the fact that better fault analyses for each story, as well as precautionary maintenance operations, are possible. In addition, the safety circuit of this invention is also immune to the influences of electromagnetic interference.

One embodiment of this invention pertains to a door safety circuit for monitoring at least one story door, including a latching device, of a lift installation, the circuit comprising a transmitter and a receiver, wherein a non-electrical signal, produced by the transmitter and operatively influenced by the latching device, is channelled to the receiver for conversion by the receiver, into an electrical signal, wherein first means for conveying are provided for conveying the non-electrical signal from the transmitter to the latching device; second means for conveying are provided for conveying the non-electrical signal at the latching device; and third means for conveying are provided for conveying the non-electrical signal from the latching device to the receiver.

In another embodiment of the door safety circuit of this invention, the latching device of a first story door is connected in series with a latching device of a least one further story door by the first, second and third means for conveying of the non-electrical signal. Preferably, the transmitter is a light source, the first, second and third means of the non-electrical signal being optical conductor portions and the receiver is a photo-electric element, wherein a light, produced by the light source, is conveyed by means of the optical conductor portions, via the latching device, to the photo-electric element, with the photo-electric element converting the light into an electrical signal. The light source may emit a constant or an intermittent pulsing light.

A variation of the previous embodiment includes an inlet optical conductor, the inlet optical conductor, when the story door is closed, being connected with an outlet optical conductor, with the inlet conductor being arranged at a movable part of the latching device.

A further variation of the previous embodiment includes an optical conductor loop, with the optical conductor loop, when the story door is closed, connecting an input optical conductor with an output optical conductor, with the optical conductor loop being arranged at a movable part of the latching device.

An additional variation of the previous embodiment includes a reflector for reflecting a light beam issuing from a inlet optical conductor, to an outlet optical conductor, with the reflector being arranged at a movable part of the latching device. Preferably, the light source, for the checking of the optical conductors, is connectable with the photo-electric element and a respective photo sensor is provided for each partial optical conductor portion, with the signal of each photo sensor being fed to a failure recognition circuit.

In a further embodiment of the door safety circuit of this invention, the transmitter is a pressure source, the several means for the conveyance of the non-electrical signal are pressure duct pieces, the receiver is a pressure transducer, and wherein a medium under pressure, supplied by the pressure source, is conveyed by means of the pressure duct pieces, via the latching device, to a pressure transducer, with the pressure transducer converting the pressure, prevailing in the pressure medium, into an electrical signal. Preferably, the pressure medium is a compressed gas.

A variation of the previous embodiment includes an inlet pressure duct, the inlet pressure duct, when the story door is closed, being connected with an outlet pressure duct, with the inlet pressure duct being arranged at a movable part of the latching device.

A further variation of the previous embodiment includes a pressure duct loop, with the pressure duct loop, when the story door is closed, connecting an input pressure duct with an output pressure duct, with the pressure duct loop being arranged at a movable part of the latching device.

An additional variation of the previous embodiment includes a pinching device, the pinching device, when the story door is open, preventing a pressure propagation in the pressure duct pieces by pinching, with the pinching device being arranged at a movable part of the latching device. Preferably, the pressure source, for checking the pressure ducts, is connected with the pressure transducer and a respective pressure sensor is provided for each pressure duct piece, with the signal of each pressure sensor being fed to a failure recognition circuit.

In an additional embodiment of the door safety circuit of this invention, the transmitter is a source of sound, the several means for the conveyance of the non-electrical signal are acoustic duct pieces and the receiver is a sound transducer and wherein mechanical waves produced by the sound source are conveyed, in the form of sound, by the acoustic duct pieces, via the latching device, to a sound transducer which converts the sound into an electrical signal. The sound source may emit a constant or an intermittent pulsing sound.

A variation of the previous embodiment includes an inlet acoustic duct, the inlet acoustic duct, when the story door is closed, being connected with an outlet acoustic duct, with the outlet acoustic duct being arranged at a movable part of the latching device.

A further variation of the previous embodiment includes an acoustic duct loop, with the acoustic duct loop, when the story door is closed, connecting an input acoustic duct with an output acoustic duct, with the acoustic duct loop being arranged at a movable part of the latching device.

An additional variation of the previous embodiment includes a pinching device, the pinching device, when the story door is open, preventing the sound propagation in the acoustic duct by pinching, with the pinching device being arranged at a movable part of the latching device. Preferably, the sound source, for the checking of the acoustic duct pieces, is connected with the sound transducer and a respective sound sensor is provided for each acoustic duct piece, the signal of each sound transducer being fed to a failure recognition circuit.

In a differing embodiment of the door safety circuit of this invention, the transmitter is a pressure source, the several means for the conveyance of the non-electrical signal are pressure duct pieces and the receiver is a barrier, and wherein a medium under pressure, supplied by a pressure source, moves a body by means of the pressure duct pieces, via the latching device, towards the barrier, with the barrier converting the movement of the body into an electrical signal. Preferably, the body is either a ball or a cylinder.

A variation of the previous embodiment includes an inlet pressure duct, the inlet pressure duct, when the story door is closed, being connected with an outlet pressure duct, with the inlet pressure duct being arranged at a movable part of the latching device.

A further variation of the previous embodiment includes a pressure duct loop, with the pressure duct loop, when the story door is closed, connecting an input pressure duct with an output pressure duct, with the pressure duct loop being arranged at a movable part of the latching device.

An additional variation of the previous embodiment includes a pinching device, the pinching device, when the story door is open, preventing a passage of the body by pinching the pressure duct, with the pinching device being arranged at a movable part of the latching device.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
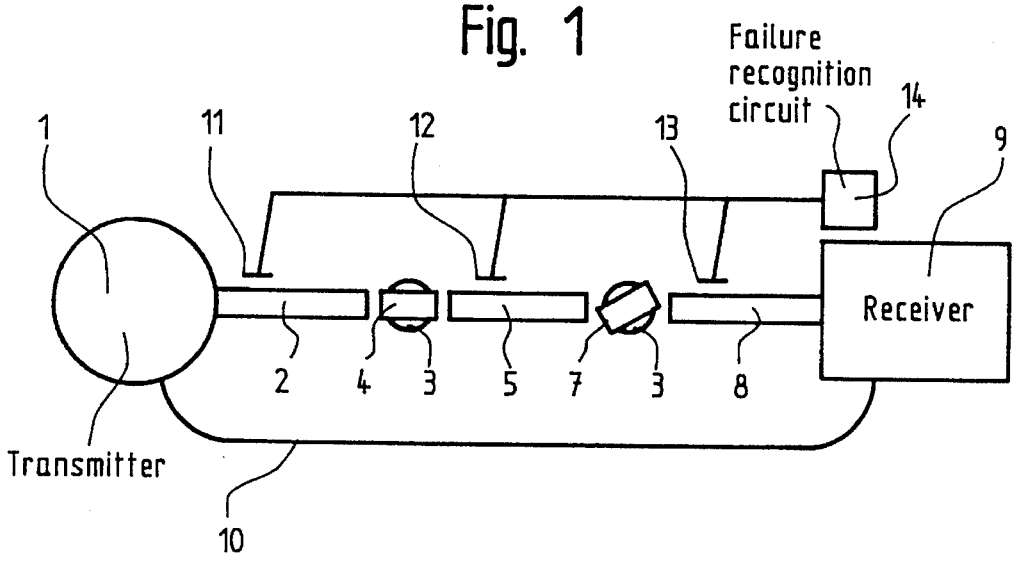
FIG. 1 is a schematic illustration of a safety circuit according to the invention.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

A transmitter, which produces a non-electrical signal, is denoted by numeral 1 in FIGS. 1 to 6, wherein the non-electrical signal is guided from a first conductor partial portion or first conductor portion 2 to a latching device 3 of a first, non-illustrated story door. In the illustrated operative position of the latching device 3 of the first story door, the non-electrical signal is guided, channelled or conveyed by means of a second conductor partial portion 4, which is arranged at the latching device 3 of the first story door, to a third conductor partial portion 5 and via the latter to a latching device **3*a* of a non-illustrated, second story door. In the illustrated rest position of the latching device 3*a* of the second story door, the non-electrical signal is not guided by means of a fourth conductor partial portion 7, which is arranged at the latching device 3*a* of the second story door, to a fifth conductor partial portion 8, so that no non-electrical signals are passed to a receiver 9. In the illustrated arrangement, the lift installation includes two story doors. In the case of lift installations with more than two story doors, the latching device of any further story doors (not shown) are also connected, in series, by means of further conductor partial portions (not shown). For checking of the transmitter 1, receiver 9 and conductor partial portions 2, 4, 5, 7 and 8, a direct or continuous conductor 10 is provided, on the one hand, for the testing of transmitter 1 and receiver 9 and, on the other hand, for the testing of conductor partial portions 2, 4, 5, 7 and 8. For conductor partial portions 2, 5 and 8, a respective sensor 11, 12 and 13 is provided, the signal of which is fed to a failure recognition circuit 14. The fault recognition for each story as well as for precautionary maintenance operations in the safety circuit are facilitated substantially by means of the failure recognition circuit 14**.

A first variation of the embodiment of the safety circuit described with reference to FIG. 1 is illustrated in FIGS. 2 to 6. A light source is provided as the transmitter, an optical conductor is provided as means for the guidance of the non-electrical signal and a photo electric element is provided as the receiver, the latter converting the non-electrical signal, in the form of constant or continuous light, into an electrical signal.

Figure 2:
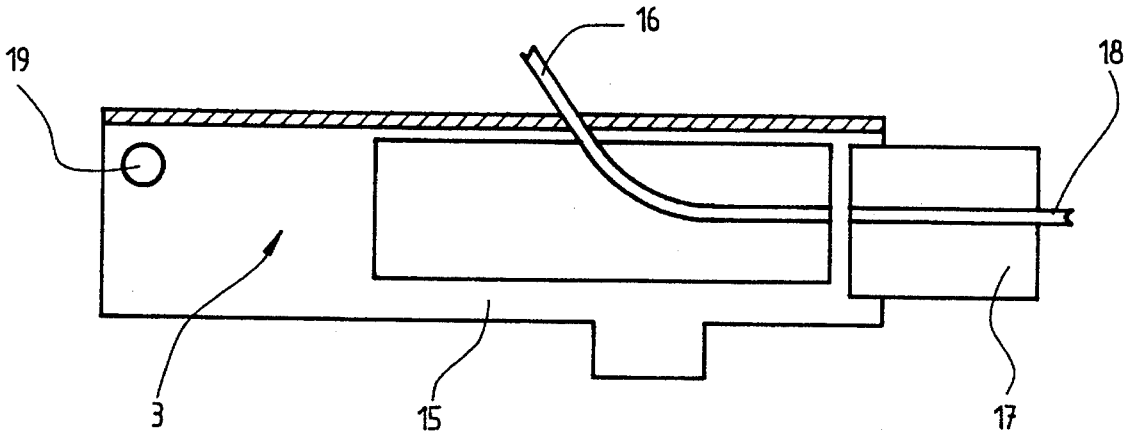
FIG. 2 is a latching device with an optical conductor.

In FIG. 2, an input or inlet optical conductor 16 is arranged on a movable part 15 of latching device 3 illustrated in the operative position and an output or outlet optical conductor 18 is arranged on a fixed part 17 of the latching device. The ends of the optical conductors 16 and 18 are oriented and spaced in such a manner that the light issuing from inlet optical conductor 16 can enter into outlet optical conductor 18. On the opening of the story door, the movable part 15 of latching device 3 is pivoted about a pivotal point 19 so that the transmission of light from inlet optical conductor 16 is interrupted relative to outlet optical conductor 18.

Figure 3:
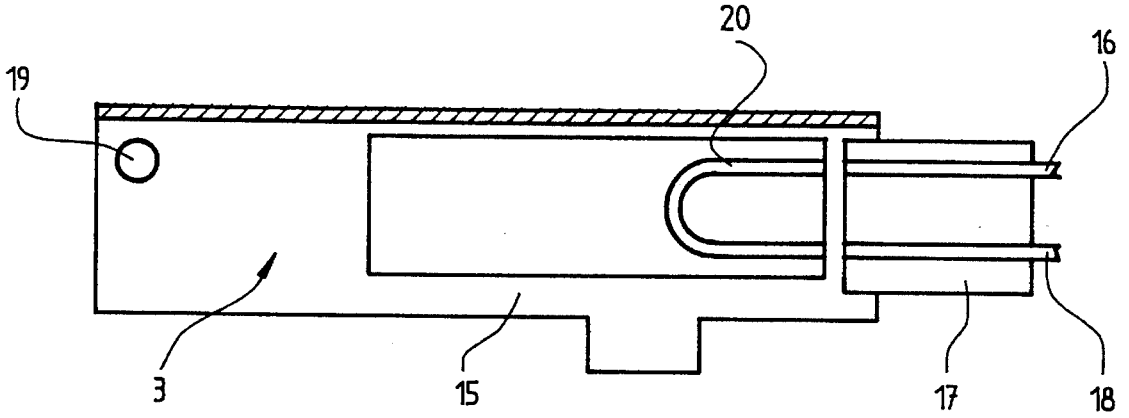
FIG. 3 is a latching device with an optical conductor loop.

In FIG. 3, inlet optical conductor 16 and outlet optical conductor 18 are arranged on fixed part 17 of latching device 3. An optical conductor loop 20 is so arranged on movable part 15 of latching device 3 that optical conductors 16 and 18 are connected together optically in the illustrated operative position of latching device 3.

Figure 4:
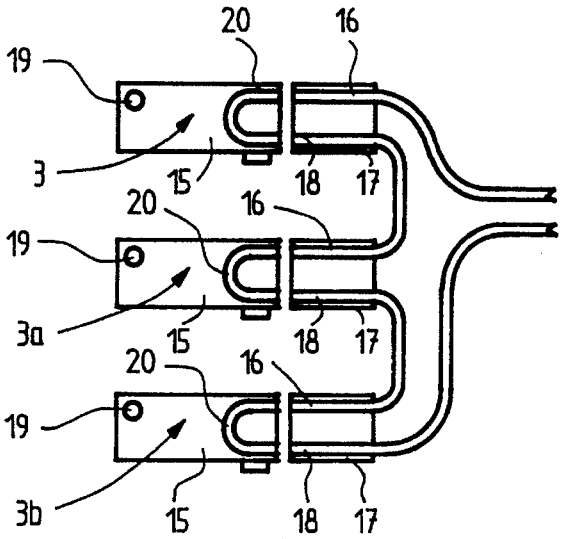
FIG. 4 shows a plurality of latching devices connected in series by optical conductors.

Latching devices 3, 3*a* and 3*b*, which are connected in series by optical conductors, are illustrated in FIG. 4. Latching devices 3, which are shown in the operative position, via their optical conductor loops 20, optically connect the optical conductor pieces, whereby an optical passage by means of latching devices 3, 3*a* and 3*b*, is produced and whereby the door safety circuit thus reports all story doors as being closed.

Figure 5:
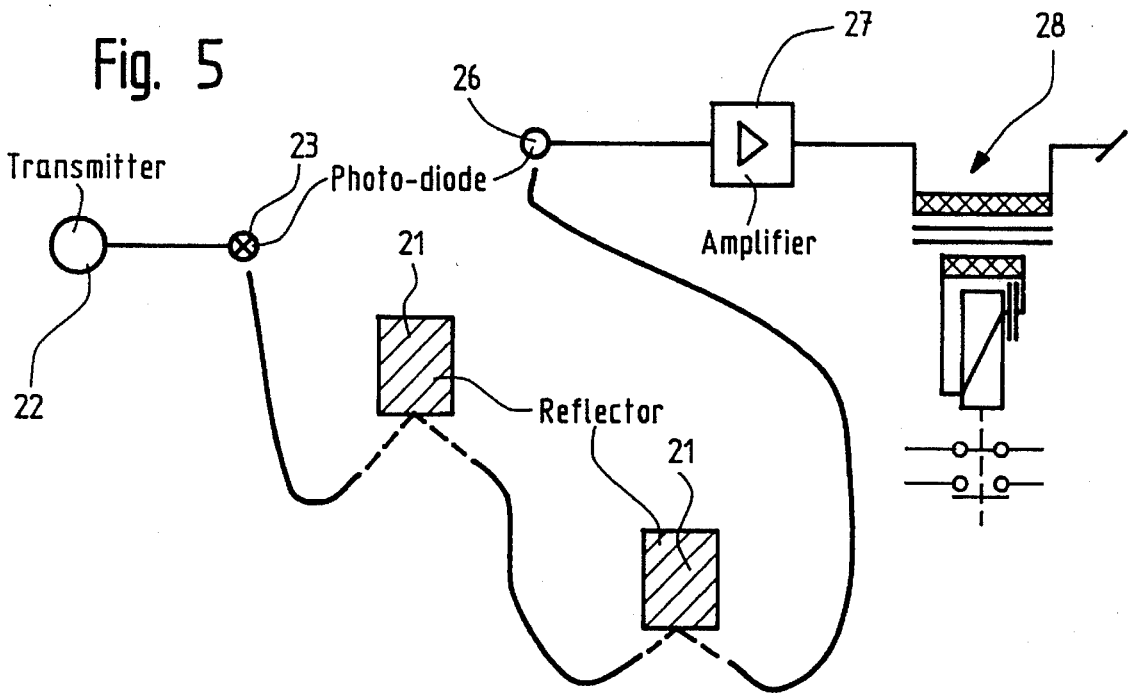
FIG. 5 is a safety circuit with reflectors, wherein the reflectors are arranged at the latching devices, for reflection of a light beam.
Figure 6:
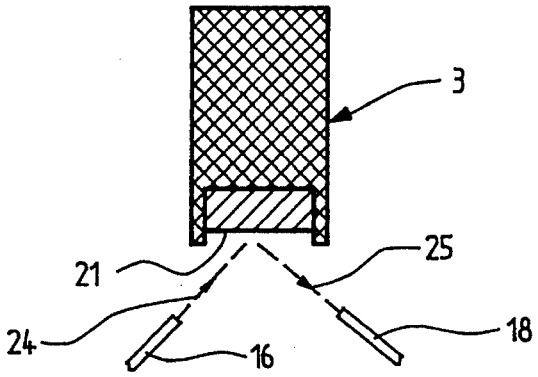
FIG. 6 discloses details of the safety circuit of FIG. 5.

FIGS. 5 and 6 illustrate another variation of this invention wherein a reflector 21, arranged on latching device 3, is for example, made of chromium-plated synthetic material, in which the transmitter 22, by means of a first photo-diode 23, emits pulse-like or intermittent pulsing light which is guided to reflector 21 by optical inlet conductor 16. An inlet light beam 24, which emanates from inlet optical conductor 16, is deflected by deflector 21 into an outlet optical beam 25 and received by outlet optical conductor 18, which guides the light to the reflector 21*a* of the following latching device 3*a*. After the light has been guided by way of reflectors 21, 21*a*, etc. of the latching devices connected in series in the safety circuit, the light is converted by a second photo-diode 26, an amplifier 27 and a transformer 28 into an electrical control signal.

Each latching device 3, is provided with a respective non-illustrated photo-sensor, which monitors the light beam and the signals thereof are conducted to a non-illustrated circuit for failure recognition, via which the switching states at all latching devices 3 are centrally monitored and evaluated for fault analysis as well as for precautionary maintenance operations.

In a second variation of the embodiment of the safety circuit described with reference to FIG. 1, a pressure source is provided as the transmitter, a pressure duct is provided as the conductor of the non-electrical signal and a pressure transducer is provided as the receiver, wherein a pressure medium, for example a gas under pressure, provided by a pressure source, is guided by means of the pressure duct via latching device 3 to the pressure transducer which converts the pressure of the pressure medium into an electrical signal. An inlet pressure duct, which, when the story door is closed, is connected with an outlet pressure duct, with the inlet pressure duct being arranged at movable part 15 of latching device 3. The pressure duct loop, which, when the story door is closed, connects the inlet pressure duct with the outlet pressure duct, with the pressure duct loop being arranged in place of the inlet pressure duct at movable part 15 of the latching device 3. A non-illustrated pinching or constriction device, which, when the story door is open, prevents the pressure propagation in the pressure duct by pinching, can also be arranged in place of the inlet pressure duct at movable part 15 of the latching device 3.

For each latching device 3, respective pressure sensors are provided, which monitor the pressure, and signals thereof are conducted to a failure recognition circuit, by which the switching states at all latching devices 3 are centrally monitored and evaluated for fault analysis as well as for precautionary maintenance operations.

In a third variation of the embodiment of the safety circuit described with reference to FIG. 1, a source of sound is provided as the transmitter, an acoustic duct is provided as the conductor of the non-electrical signal and a sound transducer is provided as the receiver, wherein mechanical waves, produced by the sound source in the form of constant or pulse-like sounds, are guided by means of the acoustic duct via latching device 3 to the sound transducer which converts the sound into an electrical signal. An inlet acoustic duct, which, when the story door is closed, is connected with an outlet pressure duct, with the inlet acoustic duct being arranged at movable part 15 of latching device 3. An acoustic loop, which, when the story door is closed, connects the inlet acoustic duct with the outlet acoustic duct, with the acoustic duct loop being arranged in place of the inlet acoustic duct at movable part 15 of latching device 3. A non-illustrated pinching or constricting device, which, when the story door is open, prevents the propagation of sound in the acoustic duct by pinching, can also be arranged in place of the inlet acoustic duct at movable part 15 of latching device 3.

For each latching device 3, respective sound sensors are provided, which monitor the sound and the signals thereof are conducted to a failure recognition circuit, by which the switching states at all latching devices 3 are centrally monitored and evaluated for fault analysis as well as for precautionary maintenance operations.

Figure 7:
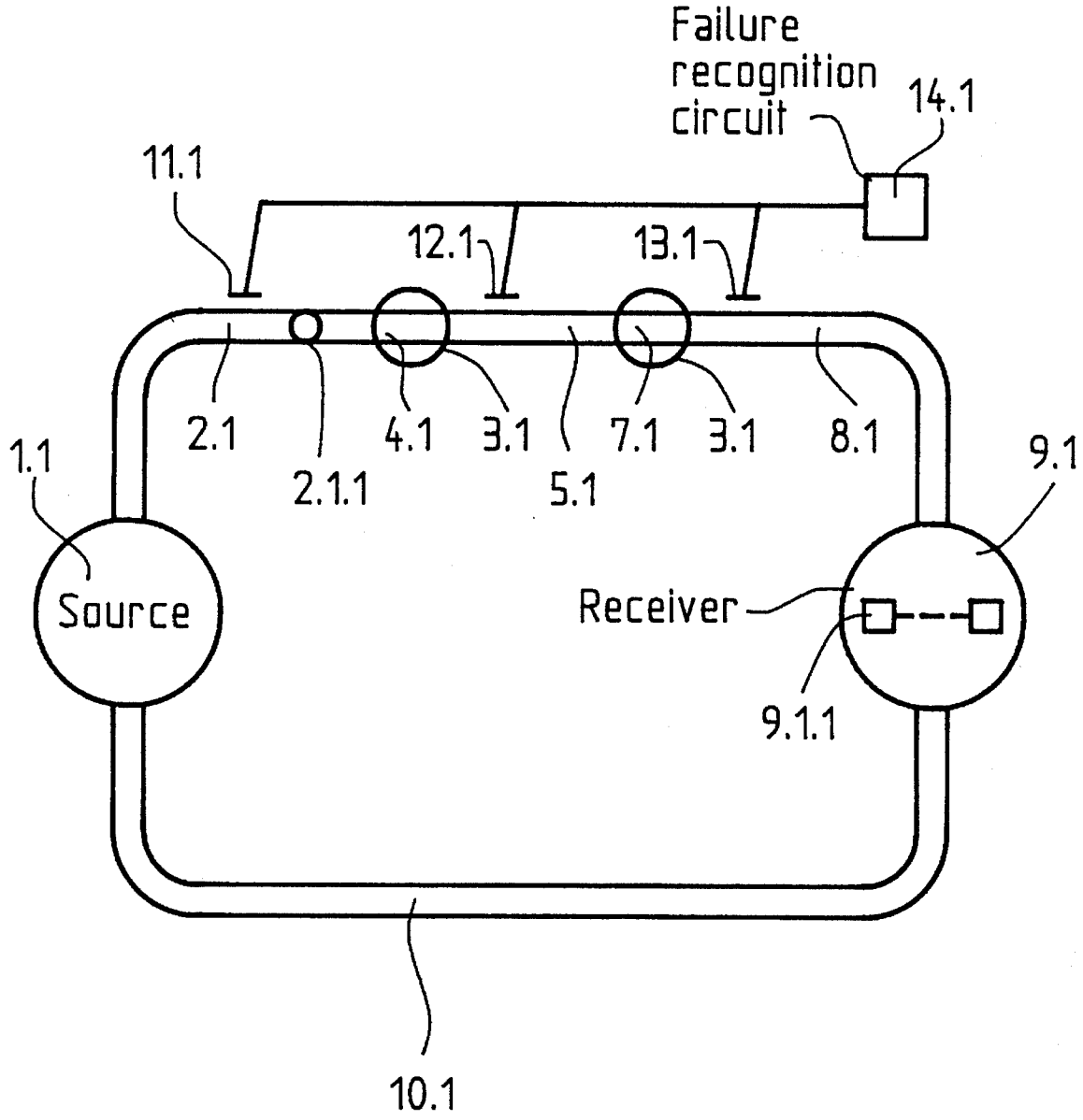
FIG. 7 shows a safety circuit wherein pressure is used to monitor the latching devices.

FIG. 7 shows a fourth variation of the embodiment of the safety circuit described with reference to FIG. 1, a pressure source 1.1 is provided as the transmitter, pressure ducts 2.1, 4.1, 5.1, 7.1, and 8.1 are provided as the conductor of the non-electrical signal and a barrier 9.1.1 is provided as the receiver 9.1, wherein a pressure medium, under pressure by a pressure source 1.1, moves a body 2.1.1, for example a ball or a cylinder, by means of the pressure ducts via latching device 3.1 to the barrier 9.1.1 which converts the passage of the body 2.1.1 into an electrical signal. An first pressure duct 2.1, which, when the story door is closed, is connected with an second pressure duct 5.1, through a first pressure duct loop 4.1 arranged at movable part 15 (FIG. 2) of latching device 3.1. A second pressure duct loop 7.1, which, when the story door is closed, connects the second pressure duct 2.1 with the third pressure duct 8.1, with the second pressure duct loop 5.1 being arranged in place of the inlet pressure duct at movable part 15 of latching device 3. A direct pressure duct 10.1 may be positioned between the pressure receiver 9.1 and the pressure source 1.1. Alternatively, first and second pressure loops 4.1, 7.1, may be actuated by a pinching or constriction device, which, when the story door is open, prevents the passage of the body by pinching of the pressure loops, can also be arranged in place of the first and second pressure ducts 2.1, 5.1; at movable part 4.1, 7.1 respectively, of latching device 3.1.

For each latching device 3, respective passage sensors 11.1, 12.1, 13.1 are provided, which monitor the pressure and the signals thereof are conducted to a failure recognition circuit 14.1, by which the switching states at all latching devices 3.1 are centrally monitored and evaluated for fault analysis as well as for precautionary maintenance operations.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A door safety circuit for monitoring a plurality of story doors of an lift installation, each of said plurality of story doors including a latching device, said door safety circuit comprising:

a transmitter for transmitting a non-electrical signal;

a receiver for receiving said non-electrical signal and for converting said non-electrical signal into an electrical signal;

said non-electrical signal being influenced by operation of said latching device;

first means for conveying said non-electrical signal from said transmitter to said latching device;

second means for conveying said non-electrical signal associated with said latching device;

third means for conveying said non-electrical signal from said latching device to said receiver; and a serial connection between said transmitter and receiver through each of said plurality of story doors when each of said plurality of story doors are latched closed.

2. The door safety circuit of claim 1, wherein the latching device of a first story door is connected in series with a latching device of a least one further story door by the first, second and third means for conveying of the non-electrical signal.

3. The door safety circuit of claim 2, wherein the transmitter is a light source, the first, second and third means of the non-electrical signal being optical conductor portions and the receiver is a photo-electric element, wherein a light, produced by the light source, is Conveyed by means of the optical conductor portions, via the latching device, to the photo-electric element, with the photo-electric element converting the light into an electrical signal.

4. The door safety circuit of claim 3, wherein the light source emits a constant light.

5. The door safety circuit of claim 3, wherein the light source emits an intermittent pulsing light.

6. The door safety circuit of claim 3, further including an inlet optical conductor, the inlet optical conductor, when the story door is closed, being connected with an outlet optical conductor, with the inlet conductor being arranged at a movable part of the latching device.

7. The door safety circuit of claim 3, further including an optical conductor loop, with the optical conductor loop, when the story door is closed, connecting an input optical conductor with an output optical conductor, with the optical conductor loop being arranged at a movable part of the latching device.

8. The door safety circuit of claim 3, further including a reflector for reflecting a light beam issuing from a inlet optical conductor, to an outlet optical conductor, with the reflector being arranged at a movable part of the latching device.

9. The door safety circuit of claim 3, wherein the light source, for the checking of the optical conductors, is connectable with the photo-electric element and a respective photo sensor is provided for each partial optical conductor portion, with the signal of each photo sensor being fed to a failure recognition circuit.

10. The door safety circuit of claim 2, wherein the transmitter is a pressure source, the several means for the conveyance of the non-electrical signal are pressure duct pieces, the receiver is a pressure transducer, and wherein a medium under pressure, supplied by the pressure source, is conveyed by means of the pressure duct pieces, via the latching device, to a pressure transducer, with the pressure transducer converting the pressure, prevailing in the pressure medium, into an electrical signal.

11. The door safety circuit of claim 10, wherein the pressure medium is a compressed gas.

12. The door safety circuit of claim 10, further including an inlet pressure duct, the inlet pressure duct, when the story door is closed, being connected with an outlet pressure duct, with the inlet pressure duct being arranged at a movable part of the latching device.

13. The door safety circuit of claim 10, further including a pressure duct loop, with the pressure duct loop, when the story door is closed, connecting an input pressure duct with an output pressure duct, with the pressure duct loop being arranged at a movable part of the latching device.

14. The door safety circuit of claim 10, further including a pinching device, the pinching device, when the story door is open, preventing a pressure propagation in the pressure duct pieces by pinching, with the pinching device being arranged at a movable part of the latching device.

15. The door safety circuit of claim 10, wherein the pressure source, for checking the pressure ducts, is connected with the pressure transducer and a respective pressure sensor is provided for each pressure duct piece, with the signal of each pressure sensor being fed to a failure recognition circuit.

16. The door safety circuit of claim 2, wherein the transmitter is a source of sound, the several means for the conveyance of the non-electrical signal are acoustic duct pieces and the receiver is a sound transducer and wherein mechanical waves produced by the sound source are conveyed, in the form of sound, by the acoustic duct pieces, via the latching device, to a sound transducer which converts the sound into an electrical signal.

17. The door safety circuit of claim 16, wherein the sound source emits a constant sound.

18. The door safety circuit of claim 16, wherein the sound source emits an intermittent pulsing sound.

19. The door safety circuit of claim 16, further including an inlet acoustic duct, the inlet acoustic duct, when the story door is closed, being connected with an outlet acoustic duct, with the outlet acoustic duct being arranged at a movable part of the latching device.

20. The door safety circuit of claim 16, further including an acoustic duct loop, with the acoustic duct loop, when the story door is closed, connecting an input acoustic duct with an output acoustic duct, with the acoustic duct loop being arranged at a movable part of the latching device.

21. The door safety circuit of claim 16, further including a pinching device, the pinching device, when the story door is open, preventing the sound propagation in the acoustic duct by pinching, with the pinching device being arranged at a movable part of the latching device.

22. The door safety circuit of claim 16, wherein the sound source, for the checking of the acoustic duct pieces, is connected with the sound transducer and a respective sound sensor is provided for each acoustic duct piece, the signal of each sound transducer being fed to a failure recognition circuit.

23. The door safety circuit of claim 2, wherein the transmitter is a pressure source, the several means for the conveyance of the non-electrical signal are pressure duct pieces and the receiver is a barrier, and wherein a medium under pressure, supplied by a pressure source, moves a body by means of the pressure duct pieces, via the latching device, towards the barrier, with the barrier converting the movement of the body into an electrical signal.

24. The door safety circuit of claim 23, wherein the body is a ball.

25. The door safety circuit of claim 23, wherein the body is a cylinder.

26. The door safety circuit of claim 23, further including an inlet pressure duct, the inlet pressure duct, when the story door is closed, being connected with an outlet pressure duct, with the inlet pressure duct being arranged at a movable part of the latching device.

27. The door safety circuit of claim 23, further including a pressure duct loop, with the pressure duct loop, when the story door is closed, connecting an input pressure duct with an output pressure duct, with the pressure duct loop being arranged at a movable part of the latching device.

28. The door safety circuit of claim 23, further including a pinching device, the pinching device, when the story door is open, preventing a passage of the body by pinching the pressure duct, with the pinching device being arranged at a movable part of the latching device.

29. The story door safety circuit of claim 1, each of said plurality of story doors including a respective first and third means for conveying non-electrical signals and each latch includes a respective second means for selectively conveying non-electrical signals between said respective first and third means;

said serial connections including a third means of one story door is coupled to a first means of a serially adjacent story;

the respective first means of a first story door in said serial connection is coupled to said transmitter and the respective third means of a last story door in said serial connection is coupled to said receiver.

* * * * *